United States Patent [19]

Breyer et al.

[11] Patent Number: 4,655,258

[45] Date of Patent: Apr. 7, 1987

[54] CLEANING APPARATUS FOR TEXTILE MACHINE

[75] Inventors: Fritz-Werner Breyer, Frauenfeld; Wolfgang K. Meyer, Winterthur, both of Switzerland

[73] Assignee: Sulzer Brothers Limited, Winterthur, Switzerland

[21] Appl. No.: 825,135

[22] Filed: Jan. 31, 1986

[30] Foreign Application Priority Data

Feb. 20, 1985 [EP] European Pat. Off. ..... 85810068.8

[51] Int. Cl.[4] ..... D03J 0/1

[52] U.S. Cl. ..... 139/1 C; 15/312 A; 901/1; 901/9; 901/40

[58] Field of Search ..... 139/1 C; 66/168; 15/312, 319

[56] References Cited

U.S. PATENT DOCUMENTS 3,525,117 8/1970 Gleaton ..... 15/312

3,991,433 11/1976 Cirino ..... 15/312

4,265,277 5/1981 Baumann et al. ..... 139/1 C

FOREIGN PATENT DOCUMENTS 126972 10/1975 Japan ..... 139/1 C 717177 2/1980 U.S.S.R. ..... 139/1 C

*Primary Examiner*—Henry S. Jaudon

*Attorney, Agent, or Firm*—Kenyon & Kenyon

[57] ABSTRACT

An automatic cleaning apparatus is provided for a plurality of weaving machines. The cleaning apparatus includes a powered vehicle on which robot arms are mounted for programmed movement into various designated areas of a weaving machine. Each arm is provided with a coupling to permit coupling to a suction nozzle or blowing nozzle which can be stored within the apparatus. Deliberate individual cleaning operations can be performed on particular units of the weaving machine at particular times or in accordance with instructions received from a weaving machine.

10 Claims, 9 Drawing Figures

CLEANING APPARATUS FOR TEXTILE MACHINE

This invention relates to a cleaning apparatus for textile machines. More particularly, this invention relates to a pneumatic cleaning apparatus for weaving machines.

As is known, there is a considerable evolution of dust and/or fluff in textile works having yarn-producing or yarn-processing machines, particularly, in connection with the use of cotton. The fluff mainly comprises fibers which can accumulate on parts of the machines and on the floor in the form of large pads or cushions. Accordingly, it is necessary to remove accumulations of fluff on a regular basis if production is not to be disturbed. To this end, various types of cleaning apparatuses or appliances have been used by an operating staff in order to remove dust and/or fluff.

By way of example, Swiss Pat. No. 419,931 describes an automatic ceiling-mounted cleaning apparatus which is able to move backwards and forwards over textile machines in a predetermined and unvarying operating cycle. This apparatus operates to produce air flows over the machines which are different according as the apparatus is on an outward or return trip. By changing over the flow direction of the blowing air, accumulations of fluff in dead corners can be avoided. Other known cleaning appliances also use elements which are formed with blowing and suction apertures. In many constructions, the blowing elements are pivoted in a reciprocated manner in order to extend their range of action. However, while devices of this type can reduce the soiling of the textile machines, the devices cannot provide local intensive cleaning of places where fluff is a particular hazzard.

In cases where automatic equipment is not used for cleaning, it becomes necessary to have the operating personnel of a textile works preform the cleaning operation on a periodic basis. However, this cleaning work frequently calls for considerable strength on the part of the operating personnel since the cleaning appliances and cleaning elements must be guided manually while machine dimensions are often so considerable that substantial gripping spaces must be overcome. In some cases, manual cleaning of an operating machine is impossible because of the risk of accident.

Accordingly, it is an object of the invention to provide a cleaning apparatus for a textile machine which is of compact construction and which is simple to use.

It is another object of the invention to provide for the automated intensive cleaning of localized places in a textile machine.

It is another object of the invention to reduce the size and bulk of a cleaning apparatus for the cleaning of weaving machines.

It is another object of the invention to be able to clean textile machines on an individual program basis.

Briefly, the invention provides a cleaning apparatus for a textile machine which is comprised of a powered vehicle, at least one movable arm which is mounted on the vehicle and which has a pneumatic duct therein, a nozzle secured to the arm in communication with the duct and control means for moving the arm relative to a textile machine in order to position the nozzle at a predetermined area of the textile for pneumatic removal of dust and fluff from the predetermined area of the machine. The vehicle may be track guided, by means of a track disposed along a series of textile machines, such as weaving machines within a textile plant. Further, the vehicle can be guided automatically by the control means to a selected textile machine in order to perform a programmed cleaning operating on the textile machine.

The cleaning apparatus enables a plurality of textile machines to be cleaned by individual cleaning programs. For example, the cleaning apparatus can be used for the cleaning, at regular intervals, of parts of one or more textile machines which are particularly at risk from fluff with or without stopage of the machines. In the case of weaving machines, the cleaning apparatus may suck away the fluff from yarn-guiding parts in a weft yarn entry zone. In another form of operation, the cleaning apparatus can be used to ensure that loose fibers which in substantial accumulations might lead to warp yarn breakages are removed continuously from the warp yarns of a weaving machine. Consequently, the continuous use of one or more cleaning apparatuses increases operating efficiency and also improves cloth quality.

In the case of warp or article changes in weaving machines, the cleaning apparatus can, without human intervention, perform specially programmed intensive cleaning operations such as sucking away large accumulations of fluff inside the weaving machines.

When a number of function elements, such as nozzles, are provided on the cleaning apparatus, independent cleaning operations can be performed simultaneously. For example, the floor of a weaving plant can be cleaned by suitable means disposed in the bottom part of the cleaning apparatus as the apparatus moves across the floor.

Unlike previously known cleaning apparatuses suspended above the textile machines on separate rails or bars, no fluff can drop from the cleaning apparatus unto the textile machines. Further, the elimination of separate hanger rods or bars reduces the initial installation cost of the cleaning apparatus. Further, accurate guiding of the nozzles close to the areas to be cleaned reduces the amount of air throughput required. Hence, the air facilities can be of smaller dimensions than in conventional appliances.

The cleaning apparatus is also provided with a filter tank which communicates with the pneumatic duct of each movable arm so as to receive dust and fluff drawn into the duct through a nozzle. Further, the cleaning apparatus can be moved to a disposal station so that the filter tank can be emptied from time-to-time.

These and other objects and advantages of the invention will become more apparent from the following detailed description taken in conjunction with the accompanying drawings wherein.

Figure 1:
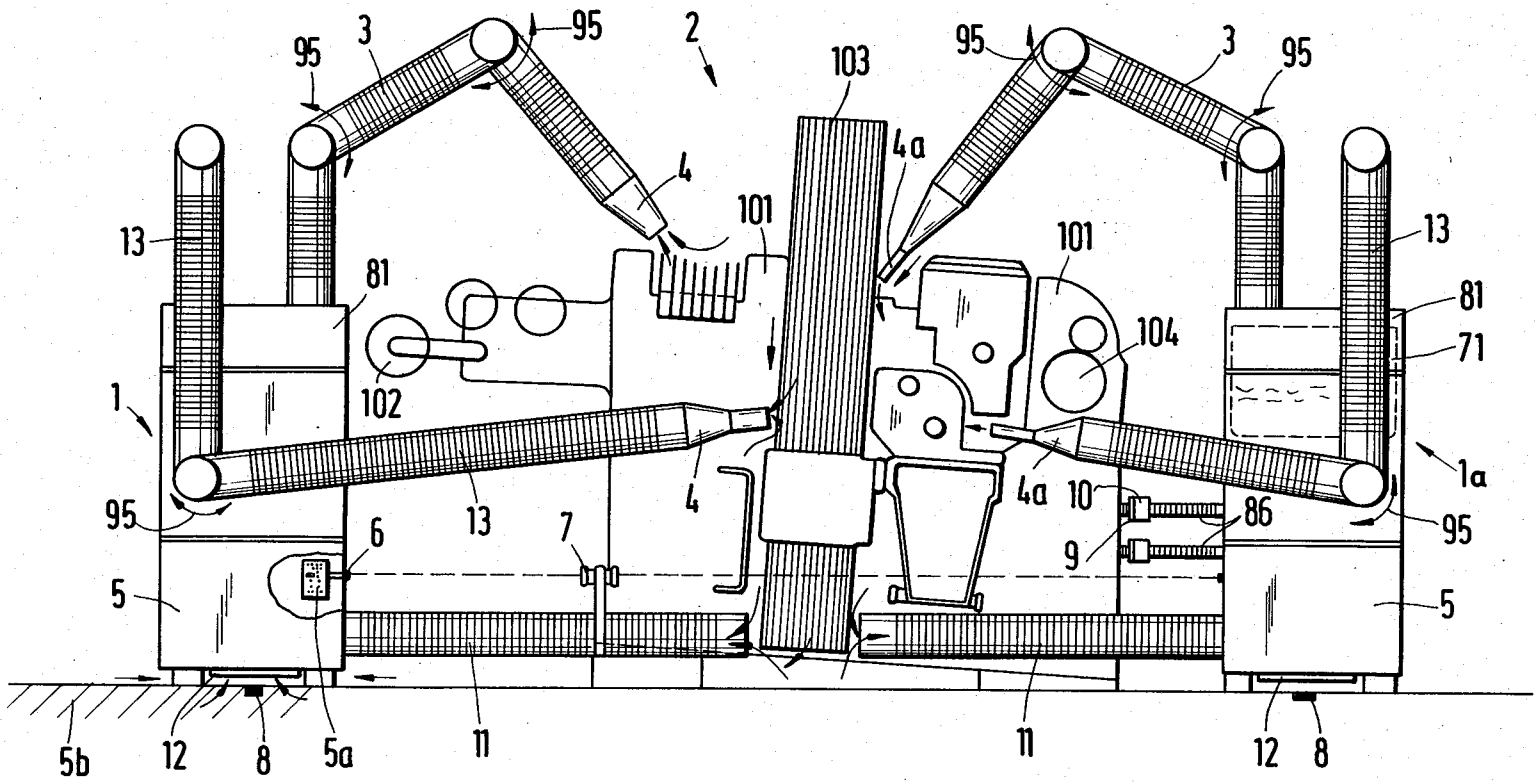
FIG. 1 illustrates a view of a pair of cleaning apparatuses adjacent a stationary weaving machine in accordance with the invention.
Figure 2A:
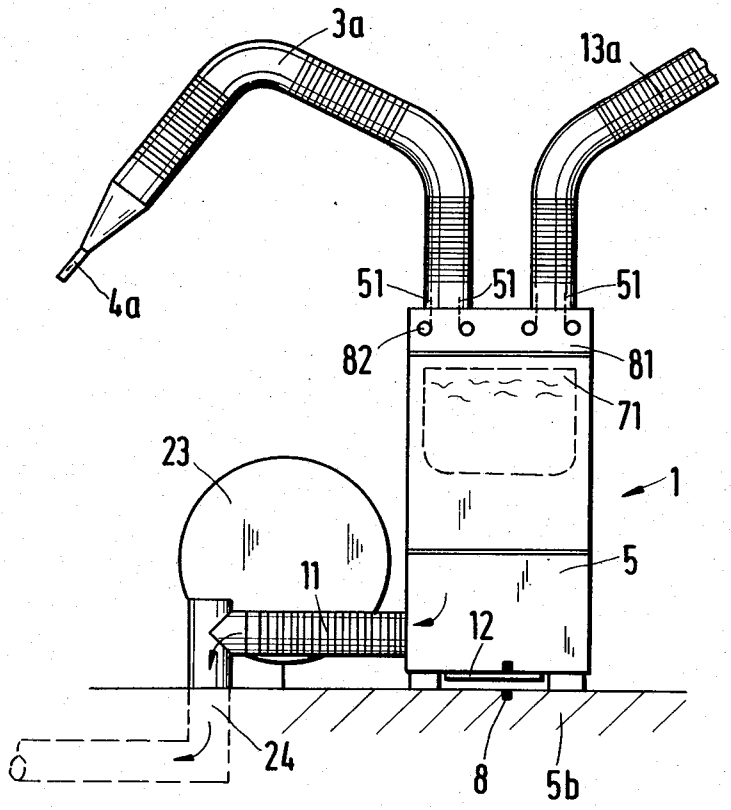
FIG. 2 illustrates a cleaning apparatus of FIG. 1 in a position over a disposal station.
Figure 3:
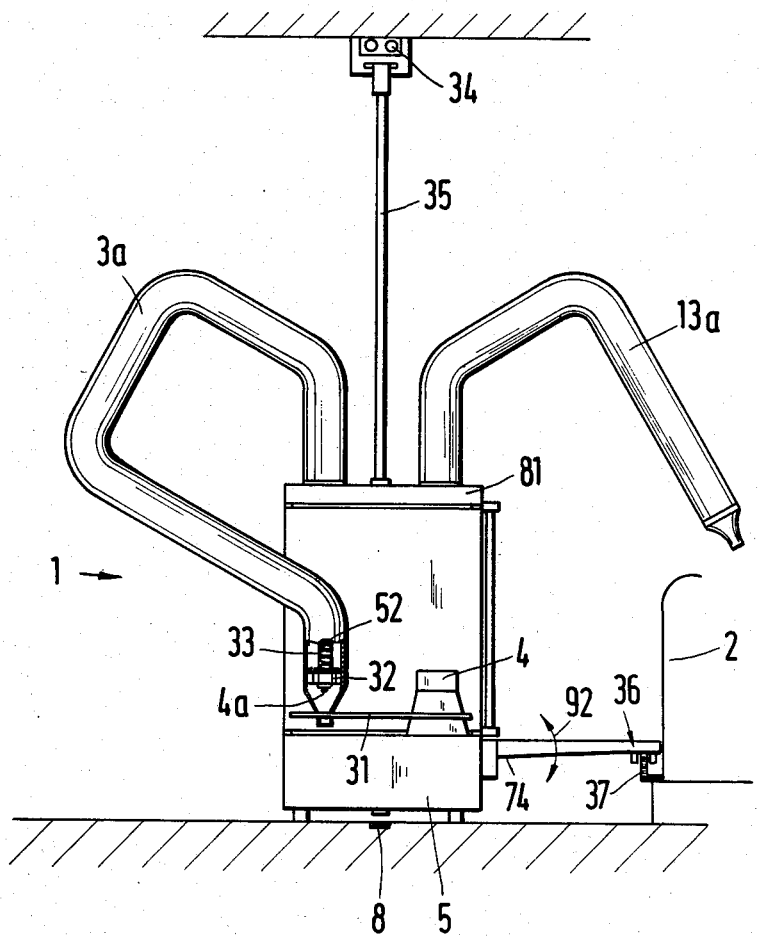
Figure 5B:
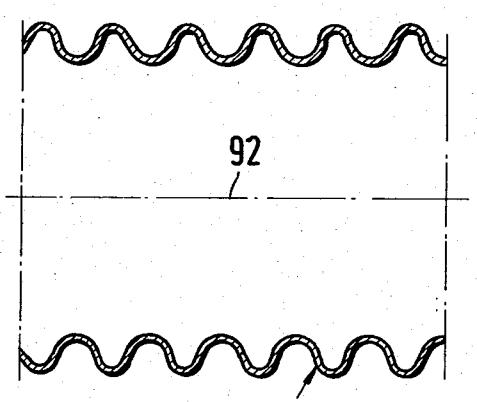
Figure 5A:
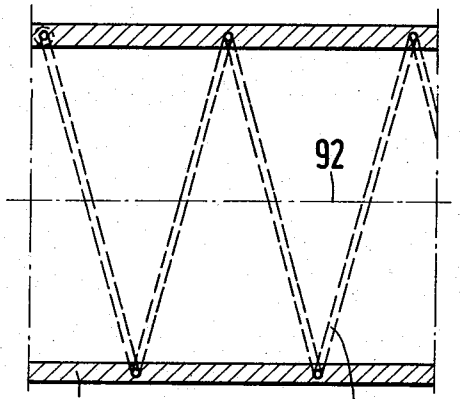
Figure 5:
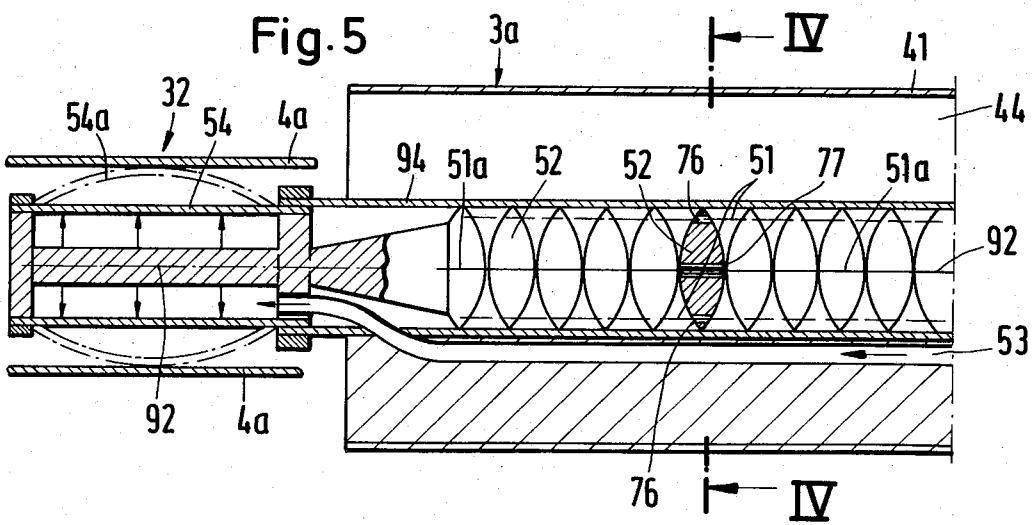
Figure 4:
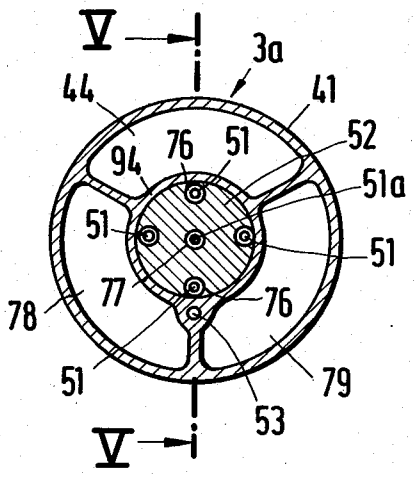
Figure 5C:
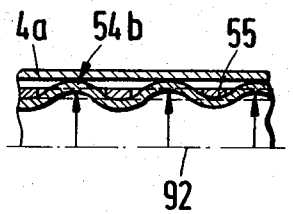

FIG. 2*a* illustrates a cleaning apparatus of FIG. 1 disposed adjacent to a disposal station;

FIG. 3 illustrates a modified cleaning apparatus having various auxiliary devices in accordance with the invention;

FIG. 4 illustrates a view taken on line IV—IV of FIG. 5;

FIG. 5 illustrates a cross sectional view of a part of a movable arm of the cleaning apparatus coupled to a nozzle in accordance with the invention;

FIG. 5*a* illustrates a cross sectional view of a hose forming a part of a movable arm of the cleaning apparatus in accordance with the invention;

FIG. 5*b* illustrates a part of a corrugated hose for forming a movable arm in accordance with the invention; and FIG. 5*c* illustrates a modified coupling arrangement in accordance with the invention.

Referring to FIG. 1, a pair of cleaning apparatuses 1, la are provided for the cleaning of a plurality of weaving machines 2 only one of which is illustrated for simplicity. As indicated, each weaving machine 2 includes a frame 101, a tensioning beam 102, heedles 103 and a cloth take-up beam 104. Of note, the weaving machine 2 is illustrated without the usual warp beam and cloth beam so as to indicate that an article change is taking place, for example, the insertion of a different warp and weft material to produce a different cloth.

The cleaning apparatuses 1, la are active simultaneously during the article changing operation so as to clean the weaving machine of accumulations of dust and/or fluff.

Each cleaning apparatus 1, la includes a powered vehicle 5 which constitutes the bottom zone of the apparatus. In addition, each apparatus 1 includes a pair of movable robot arms 3, 13 which are mounted on the vehicle 5 to operate as function elements and which are each provided with a pneumatic duct (not shown). In addition, each arm 3, 13 has a cleaning means in the form of a nozzle 4, 4*a* secured at the end. For example, the cleaning apparatus 1 shown on the warp beam end of the weaving machine 2 is provided with suction nozzles 4 in order to suck in dust and fluff from the weaving machine while the cleaning apparatus at the cloth beam of the weaving machine 2 is provided with blowing nozzles 4*a* in order to blow streams of air onto and into the weaving machine to clean out designated areas of the weaving machine 2. In the position shown in FIG. 1, each cleaning apparatus 1 has the robot arms 3, 13 extended. However, during travelling of each apparatus 1, the arms 3, 13 are retracted from the position shown in FIG. 1 to permit travelling from one weaving machine to another weaving machine.

Each cleaning apparatus 1, la also includes a control means in the form of an electronic control means 5*a* for moving the respective arms 3, 13 in order to position the respective nozzles 4, 4*a* at predetermined area of the weaving machine 2 for pneumatic removal of dust and fluff from these areas.

As indicated in FIG. 1, each cleaning apparatus 1, la carries an electrical receiver (sensor) 6 such as an opto-electrical element, for example, near the bottom which is adapted to cooperate with an electrical transmitter 7 on the weaving machine 2 for example, a transmitter which emits a light beam in order to receive instructions regarding the required cleaning operations to be performed on the weaving machine 2. As indicated, the receiver 6 receives a suitable signal from the transmitter 7 without contact between the cleaning apparatus 1 and the weaving machine 2. If the cleaning program is stored in the electronic control means 5*a*, a short sequence of signals is sufficient to transfer the information so that the cleaning program in the apparatus is accessed.

As shown in FIG. 1, induction tracks 8 are disposed in the floor 5*b* of the weaving plant and each is operative to guide the respective cleaning apparatus 1 through the plant into a position adjacent a weaving machine. To this end, a central control station (not shown) determines the route to a particular machine to be cleaned.

The cleaning apparatus 1, la on the cloth beam side of the weaving machine 2 is connected at two terminals 9 to couplings 10 for supplying the apparatus, for example with compressed air and electricity via lines 86. The coupling 10 can be automatically connected to the weaving machine terminal 9, for example by one of the robot arms 3, 13.

Each cleaning apparatus is provided at the bottom with additional functional elements in the form of suction hoses 11 for drawing away dust and/or fluff from the floor 5*b* under the weaving machine 2 while suction apertures 12 are provided on the underside of the vehicle 5 for direct suction. As above, the hoses 11 are retracted when the cleaning apparatus is moving between the weaving machines 2.

Figure 2:
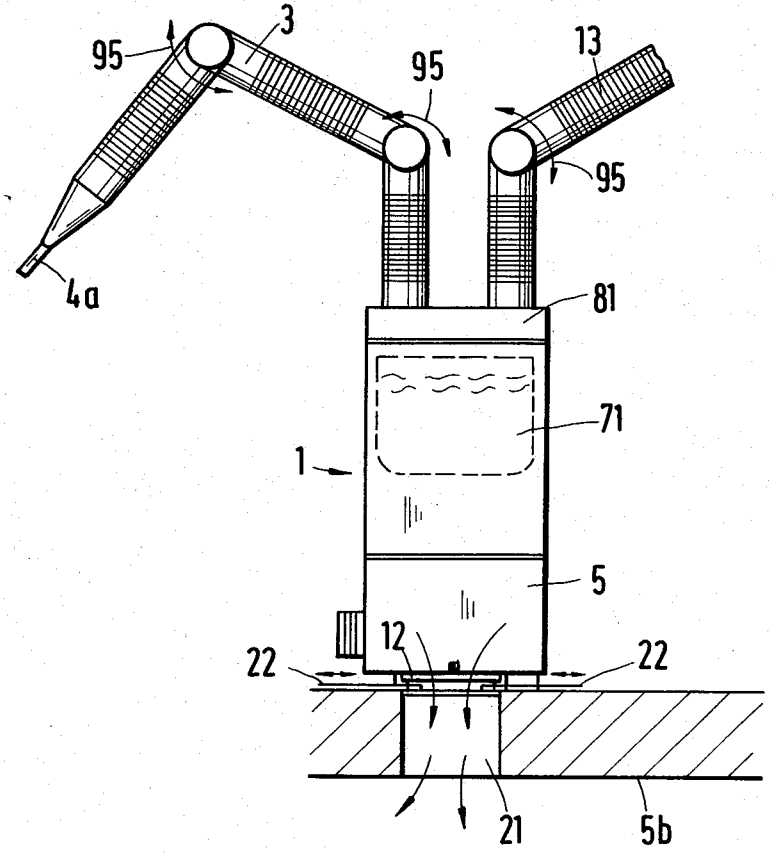

Each cleaning apparatus 1, la is also provided with a filter tank 71 at the top (only one of which is shown in FIG. 1). Each filter tank 71 communicates with the pneumatic duct in a respective robot arm 3, 13 in order to receive any dust and fluff drawn into the ducts via a suction nozzle 4. These tanks can be emptied from time-to-time in an automatic manner at a suitable disposal station or may be replaced by an empty replacement filter tank. For example, as indicated in FIG. 2, each cleaning apparatus 1, la may be brought into a position above a floor opening 21 having cover plates 22 which have been moved aside. The contents of the filter tank 71 in the apparatus can then be ejected downwardly in a suitable manner.

Alternatively, as indicated in FIG. 2*a*, each cleaning apparatus 1, la can be brought into a position laterally of a suction blower 23 which can be connected to the apparatus in order to empty the filter tank 71 by way of a suction tunnel 24. If required, each apparatus 1 can have the contents of the filter tank discharged by way of a central emptying facility in the plant.

As indicated in FIG. 1, each robot arm 3, 13 is pivotally mounted so as to be swung into different positions. In addition, each robot arm 3 is articulated at different points so as to accommodate programmed movement of a nozzle 4, 4*a* into different areas of a weaving machine. Alternatively, as indicated in FIG. 2*a*, each arm 3*a*, 13*a* may be constructed in a worm-like manner so as to be positioned relative to a weaving machine (not shown). To this end, the cleaning apparatus 1 is provided with servomotors 82 in a top part 81 which are controlled by the control means 5*a* and are adapted to control via pull cables 51, the motion of the worm-like movable arms 3*a*, 13*a*. In addition, each arm 3*a*, 13*a* is provided with bearing disks 52 as indicated in FIG. 5. The construction of the robot arms 3, 13 and the means for manipulating each arm is of generally known construction and need not be further described.

Referring to FIG. 3, each cleaning apparatus may also be provided with various auxiliary devices. For example, a storage chamber 31 may be incorporated within each apparatus for storage of blower nozzles 4 and suction nozzles 4*a* or other selectable tools (not shown). In this case, each robot arm 3*a*, 13*a*, can be provided with a coupling 32 for releaseably engaging one or the other of the nozzles 4, 4*a*. To this end, each arm 3*a*, 13*a*, can be moved into a position to engage with a nozzle 4, 4*a* in the storage chamber 31. As illustrated, the robot arm 3*a* is in a position to couple with a blowing nozzle 4*a*.

Each cleaning apparatus may also be provided with mechanical means, such as air driven rotating brushes which may be convenient from some cleaning jobs. In this case, these brushes would also be coupled to a robot arm so as to be moved into a cleaning position on a weaving machine.

As indicated in FIG. 3, the supply lines 34 for electricity and/or compressed air are disposed above the induction track 8 and communicate with each cleaning apparatus 1 via a suitable conduit 35.

Each cleaning apparatus may also be provided with means for positioning the apparatus 1 relative to a selected weaving machine 2. This means may include a guide arm 36 which can be pivoted about a bracket 74 as indicated by the arrow 92 in a vertical plane as well as an angle-section guide member 37 on the weaving machine 2 which cooperates with the guide arm 36 in order to accurately position the cleaning apparatus 1 relative to the weaving machine 2. As indicated, the angle-section guide member 37 serves to guide the cleaning apparatus 1 along the weaving machine 2. Thus, guidance of the cleaning apparatus can be transferred from the track 8 to the guide member 37 as the cleaning apparatus 1 approaches the weaving machine 2.

Referring to FIGS. 4 and 5, each robot arm 3*a* is constructed, for example, of an outer hose 41 and an inner hose 94. In addition, suitable radial partitions are provided in order to divide the space between the hoses 41, 94 into a compressed air supply line 44 and a coaxial pair of suction or return channels 78, 79. The inner hose 94 also houses dished and substantially oval-section bearing or support disks 52 which are disposed one on another and which are held together by pull cables 51 and a central bearing cable 51*a*. The cables 51 serve as the control cables for the movement of the robot arm 3*a* and extend through bores 76 in the disks 52 while the cable 51*a* extends through central bores 77 in the disks 52.

The outer hose 41 is made, for example, of flexible plastic material. In order to render the hose 41 inherently stable about a central axis 92, a bearing wire 42 can be introduced into the hose 41 as indicated in FIG. 5*a*. Alternatively, the hose 41 can be formed as a corrugated tube 43 as indicated in FIG. 5*b*.

Referring to FIG. 5, the coupling 32 at the end of the robot arm 3*a* includes a flexible cylinder wall 54 which can be pneumatically expanded in order to engage with a nozzle 4*a*. For example, the cylinder 54 can be made of a flexible plastic. As also indicated, the cylinder 54 is mounted between a pair of end walls which are interconnected by a central core coaxial of the axis 92 of the robot arm 3*a*. In addition, a line 53 extends from the robot arm 3*a* through one of the end walls into the interior of the cylinder 54 in order to deliver compressed air into the cylinder 54. In order to engage a nozzle 4*a*, compressed air is delivered by the line 53 in order to expand the cylinder 54 into the position illustrated in chain-dotted lines 54*a*. As such, the nozzle 4*a* is clamped from the inside.

Referring to FIG. 5*c*, the coupling may include a cylindrical perforate support envelope 55 about the outside of a flexible cylinder 54. Thus, when compressed air is introduced, the flexible cylinder 54 extends through the perforations of the envelope 55 into a corrugated pattern 54*b* so as to retain a nozzle 4*a* at a plurality of points.

In order to secure a nozzle or other cleaning means to the end of a robot arm, only a single valve inside the cleaning apparatus 1 needs to be opened in order to permit compressed air to flow through the passage 53 to a coupling 32. The components required for the drive movement of the vehicle 5 and the robot arm movements as indicated by the arrows 95 in FIG. 1 have not been shown in detail and are at least, partially known from the robot art.

The cleaning apparatus may also be constructed to clean textile machines such as spinning machines. Further, the cleaning apparatus can be used to clean parts of a textile machine during operation, that is, with the machine running. For example, a machine can be cleaned by the apparatus at particular selected times or times corresponding to the extent of soiling.

The invention thus provides a cleaning apparatus of relatively compact construction which can be operated from time-to-time in order to carry out programmed cleaning operations on textile machines such as weaving machines. Further, the invention provides a cleaning apparatus which can be readily adapted to blowing air onto predetermined areas of a weaving machine or drawing air in from selected areas of a weaving machine in order to carry out a cleaning operation.

What is claimed is:

1. In combination, a plurality of weaving machines; and a cleaning apparatus for removing dust and fluff from said weaving machines, said apparatus including a powered vehicle movable along said weaving machines, at least one movable arm mounted on said vehicle and having a pneumatic duct therein, a nozzle secured to said arm in communication with said duct, a sensor for receiving a control signal from a selected weaving machine and electronic control means connnected to said sensor to receive and convert a control signal from said selected weaving machine into movements of said arm relative to said selected weaving machine to position said nozzle at a predetermined area of said selected weaving machine for pneumatic removal of dust and fluff from said predetermined area.

2. The combination as set forth in claim 1 which further includes a first coupling for connecting said pneumatic duct of said cleaning apparatus to a pneumatic supply line and a second coupling for connecting said cleaning apparatus to a disposal line for dispensing of collected duct and fluff therefrom.

3. The combination as set forth in claim 1 which further comprises a coupling secured to an end of said arm and having a pneumatically expanded cylinder releaseably engaging said nozzle.

4. A cleaning apparatus for a textile machine comprising a powered vehicle, at least one movable arm mounted on said vehicle and having a pneumatic duct therein;

a nozzle secured to said arm in communication with said duct;

a sensor for receiving a control signal from a selected weaving machine; and electronic control means responsive to said control signal for moving said arm relative to a textile machine to position said nozzle at a predetermined area of the textile machine for pneumatic removal of dust and fluff from said predetermined area.

5. A cleaning apparatus as set forth in claim 4 which further includes a first coupling for connecting said pneumatic duct of said cleaning apparatus to a pneumatic supply line and a second coupling for connecting said cleaning apparatus to a disposal line for dispensing of collected duct and fluff therefrom.

6. A cleaning apparatus as set forth in claim 4 which further comprises a coupling secured to an end of said arm and having a pneumatically expanded cylinder releaseably engaging said nozzle.

7. A cleaning apparatus as set forth in claim 4 wherein said arm is flexible hose defining a compressed air supply line and a coaxial pair of suction channels in communication with said nozzle.

8. A cleaning apparatus as set forth in claim 7 which further comprises a coupling secured to an end of said arm and having a pneumatically expanded cylinder releaseably engaging said nozzle and wherein said arm includes a line for delivering compressed air into said cylinder.

9. A cleaning apparatus for a textile machine comprising a powered vehicle;

at least one flexible hose mounted on said vehicle and having a pneumatic duct therein;

a nozzle secured to said hose in communication with said duct;

a compressed air supply line in said duct in communication with said nozzle;

a coaxial pair of suction channels in said duct in communication with said nozzle; and control means for moving said hose relative to a textile machine to position said nozzle at a predetermined area of the textile machine for pneumatic removal of dust and fluff from said predetermined area.

10. A cleaning apparatus as set forth in claim 9 which further comprises a coupling secured to an end of said hose and having a pneumatically expanded cylinder releaseably engaging said nozzle and wherein said hose includes a line for delivering compressed air into said cylinder.

* * * * *

UNITED STATES PATENT AND TRADEMARK OFFICE

CERTIFICATE OF CORRECTION

PATENT NO. : 4.655,258

DATED : April 7, 1987

INVENTOR(S) : Fritz - Werner Breyer, et al

It is certified that error appears in the above—identified patent and that said Letters Patent is hereby corrected as shown below:

Column 1, line 36 "hazzard" should be -hazard-
Column 2, line 12 "stopage" should be -stoppage-
Column 2, line 38 "unto" should be -onto-
Column 3, line 16 "heedles" should be -heddless-
Column 5, line 7 "from" should be -for- Column 7, line 8 "duct" should be -dust-

Signed and Sealed this

Twenty-fourth Day of November, 1987

*Attest:*

DONALD J. QUIGG

*Attesting Officer*

*Commissioner of Patents and Trademarks*